United States Patent [19]

Hemmerling

[11] Patent Number: 4,467,562

[45] Date of Patent: Aug. 28, 1984

[54] FIRE DOOR ASSEMBLY

[75] Inventor: Gene A. Hemmerling, Richmond, Ind.

[73] Assignee: American Metal Door Company, Inc., Richmond, Ind.

[21] Appl. No.: 418,444

[22] Filed: Sep. 15, 1982

[51] Int. Cl.[3] ..... E05D 13/02; E06B 3/00; E04C 1/10

[52] U.S. Cl. ..... 49/411; 49/7; 49/501; 52/586

[58] Field of Search ..... 49/7, 6, 5, 4, 409, 49/411, 501; 52/581, 582, 586, 584, 585

[56] References Cited

U.S. PATENT DOCUMENTS

| | | | |
|---|---|---|---|
| 2,104,550 | 1/1938 | Bates | 52/582 X |
| 2,128,797 | 8/1938 | Bohnsack | 52/585 X |
| 2,137,767 | 11/1938 | Betcone | 52/584 X |
| 2,414,628 | 1/1947 | Battin | 52/586 X |
| 3,325,941 | 6/1967 | Prucha | 49/7 |
| 3,383,796 | 5/1968 | Frederick, Jr. et al. | 49/7 |
| 3,438,147 | 4/1969 | Lander | 49/7 |
| 4,035,972 | 7/1977 | Timmons | 52/586 X |
| 4,132,042 | 1/1979 | DiMaio | 49/501 X |
| 4,282,687 | 8/1981 | Teleskivi | 49/501 X |
| 4,294,055 | 10/1981 | Andresen | 49/501 X |

FOREIGN PATENT DOCUMENTS

| | | | |
|---|---|---|---|
| 424164 | 5/1967 | Switzerland | 52/586 |

*Primary Examiner*—Philip C. Kannan
*Attorney, Agent, or Firm*—Barnes & Thornburg

[57] ABSTRACT

A fire door assembly for automatically closing an opening in a wall in response to a predetermined condition has two or more door panels, a connection system for connecting a side edge of one of the door panels to an adjacent side edge of the other door panel in an edge-to-edge relationship, and flame break barriers interposed between the side edges of the panels and the connection system to provide a flame-resistant barrier between the core of each panel and the connection system. Tie bars are secured to the top and bottom edges of the panels to reinforce the edge-to-edge connection. A support system for the door has a track that is free from all external interference to allow free passage of suitably configured rollers.

15 Claims, 5 Drawing Figures

FIRE DOOR ASSEMBLY

This invention relates to fire doors, and more particularly to a prefabricated and partially assembled metal fire door assembly which minimizes installation time and reduces maintenance Many problems are present when a fire door is used for automatically closing an opening in a wall. A primary concern is to assure that over the passage of considerable lengths of time the door will still close smoothly and efficiently.

Another problem that is prevelant in the installation of a fire door assembly is the fact that an effective and efficient fire door normally has considerable mass, dependent upon the size of the opening in the wall. This creates difficulties in shipping and in the subsequent installation of the fire door assembly.

The present invention solves the aforementioned problems. The door assembly is shipped in an easily manageable assembly kit. The assembly kit is such that a minimal number of assembly steps are required to install the fire door. This is achieved by pre-welding and pre-installing as many features of the fire door as possible while still maintaining a readily portable kit assembly. The kit comes with two or more interconnectable hollow panels. A flame break channel is prefabricated within the panels to prevent the spread of fire from within a panel cavity. By panelizing the door assembly, shipping operations and the subsequent installation of the fire door assembly is greatly facilitated. All installation steps require nothing more than the snapping together of parts or the attachment of bolts. No welding or other installation steps are necessitated.

Applicant's invention also provides an automatic closing system that is responsive to an elevated temperature with respect to room temperature. The automatic closing system may not be used for a considerable length of time. When such need arises, the closing system must be functional. This is achieved in applicant's invention by ensuring that all moving parts of the automatic closing system are protected from obstruction.

It is an object of the present invention to provide a fire door assembly in prefabricated and partially assembled panel sections which can be easily transported and connected at the installation site to form the door with minimal installation time.

It is a further object of the present invention to provide a fire door assembly having panel sections which will satisfy the requirements and standards for preventing the spread of fire from within a panel cavity.

Another object of the present invention is to provide an automatic closing system for a metal fire door assembly that remains operable through extended periods of time.

Yet another object of the present invention is to provide a complete fire door assembly kit including adjustable support means, fire door panel sections, an edge-to-edge panel connection system, and an automatic closing system.

The assembly embodying the present invention comprises at least two hollow door panels, means for lockably interconnecting the panels in adjacent edge-to-edge relationship, top and bottom tie bar assemblies for rigidly securing the panels in the edge-to-edge relationship, means for preventing the spread of fire from within a panel cavity, means for slidably supporting the interconnected panels, and means for automatically closing the interconnected panels in response to an elevated temperature with respect to room temperature.

In the illustrative embodiment, the automatic closing device includes a double sheave, a single sheave, a counterweight that has a sufficient mass to pull the door closed and hold it closed in the event of fire, and a fuse link device that is temperature dependent and linked to the pulley system in such a manner that it will release the counterweight upon the occurrence of a critical elevation of temperature. A support system for the door panels includes a track constructed in such a manner that its inner channel is free from all external interference to allow a free passage of suitably configured rollers from which the door assembly is hung.

While the features of the present invention can be employed in many environments, particular advantage is enjoyed in the construction of very large fire door assemblies because the individual sections can be easily transported to the installation site prior to construction into the final product. The on-site construction is simplified greatly by the present invention, since no multi-element fastener components are needed in the field for connecting the panels together. The assembly kit also provides a reliable means for closing the door assembly automatically at any time in the event of fire.

Other features and advantages of the present invention will become apparent in view of the following detailed description of one embodiment thereof exemplifying the best mode of carrying out the invention as presently perceived, which description should be considered in conjunction with the accompanying drawings in which.

Figure 1:
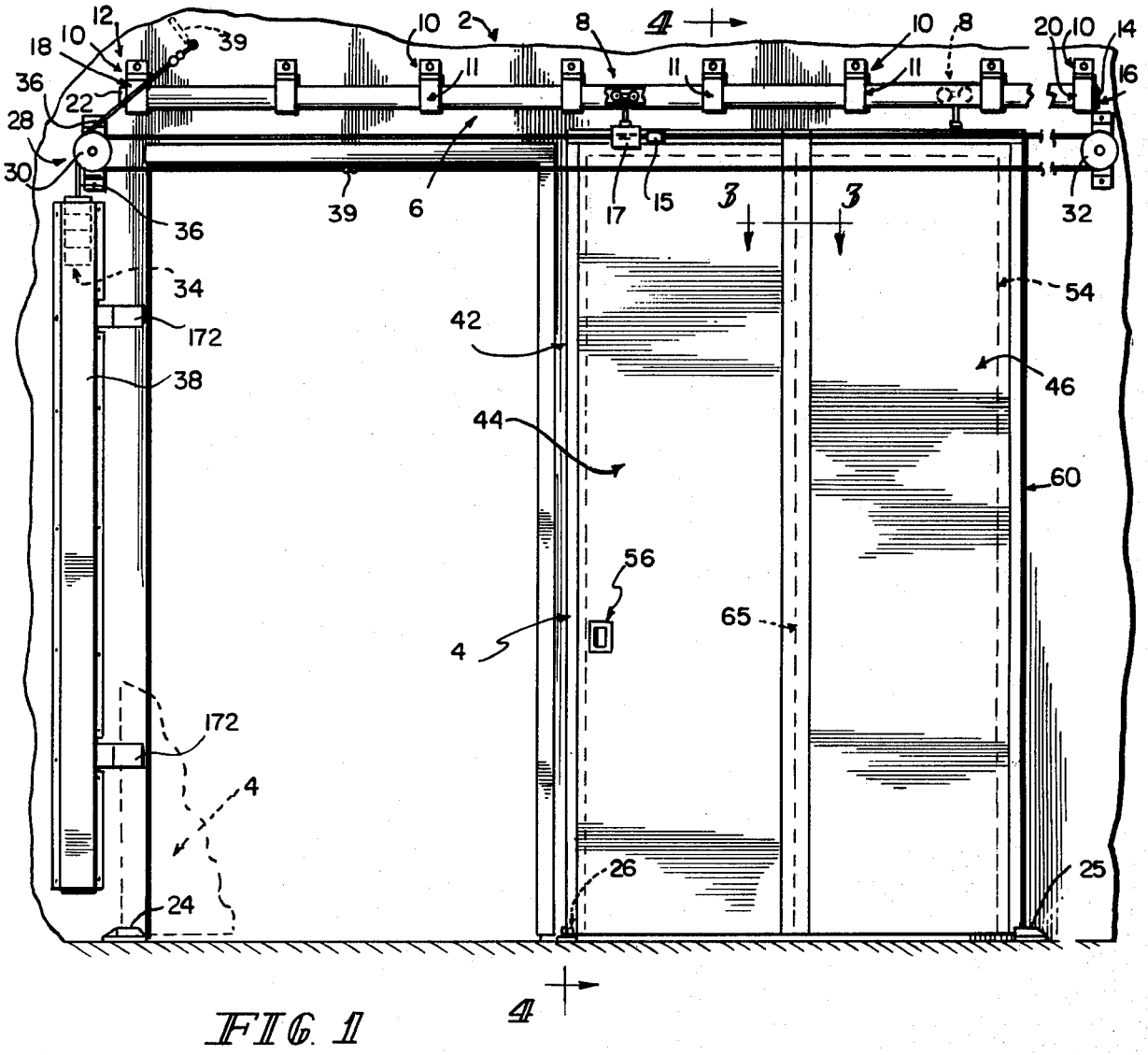
FIG. 1 is a front elevational view of a fire door assembly embodying the present invention.

Referring now to FIG. 1, a completely constructed metal fire door assembly 2 embodying the present invention is shown. The assembled door 4 is slidably supported on a box track 6 by use of 4-wheel ball bearing hangers 8. The box track 6 is mounted to the wall by use of adjustable wall angle brackets 10 and track brackets 11. The adjustable wall angle brackets 18, 20 located at the distal and proximal ends 12, 16 of box track 6 have track blinds 14, 22 for limiting travel of the hangers 8 along box track 6. Maximum travel of the assembled door 4 along box track 6 can be defined by the position of optional end stops 24, 25 (not necessarily used with the fire door assembly as the sheaves 30, 32 can be used as alternate stops) located on the floor in a line parallel and planar with the box track 6. The plane of travel of the assembled door 4 is restricted by a concealed stay roller 26 that is equidistant from end stops 24, 25 and located in a line parallel and planar with the box track 6.

To facilitate the automatic closing of door 4 along box track 6, the metal fire door assembly 2 includes a pulley system 28. The pulley system 28 includes a double sheave assembly 30 located at or near the proximal end 12 of the box track 6, a single sheave assembly 32 located at or near the distal end 16 of box track 6, and a counterweight 34 located in a weight box 38 and suspended from a pulley cable 36. The pulley cable 36 is threaded around the single sheave 32 and double sheave 30 such that the counterweight 34 hangs freely within the weight box 38. The other end of the cable 36 is attached to a fuse link device 39 that is temperature-dependent and extends through the wall so that the fuse can respond to temperature variations on either side of the wall. An additional fuse link 39 is also provided in the center of the opening.

In operation, the fuse link device 39 breaks upon a predetermined rise in temperature releasing the counterweight 34 which pulls the cable 36 until a repair link 15 in the cable 36 frictionally engages a cable bracket 17 which is rigidly attached to a four-wheel roller 8. The cable 36 in turn begins to pull the door 4 along the track 6 as the counterweight 34 descends in the weight box 38. The counterweight 34 has a mass sufficient to pull the door completely closed and hold it closed.

Figure 2:
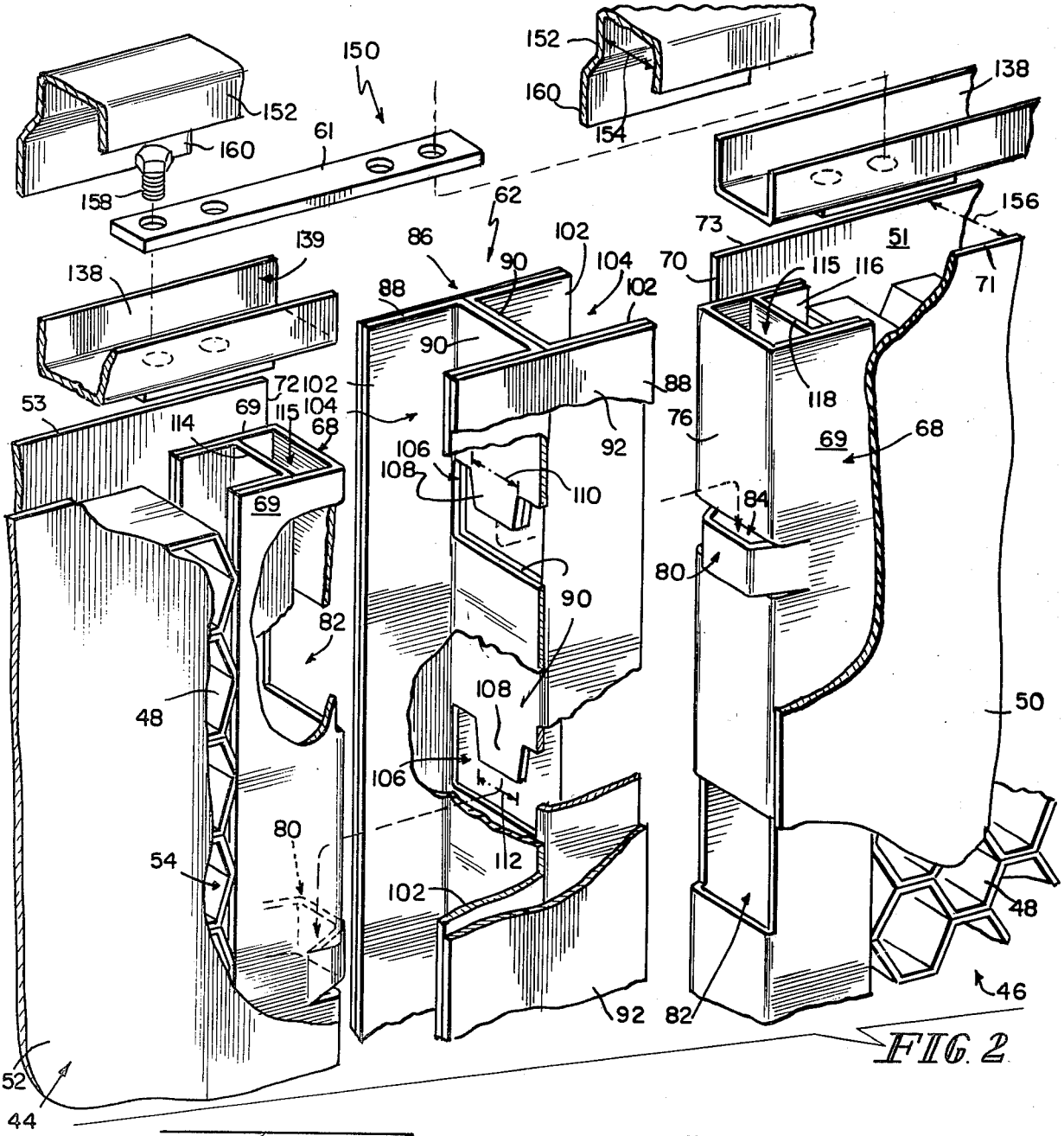
FIG. 2 is an exploded perspective view, partly broken away and cross-sectioned, of a fire door panel connection system including tie bar and flame-break assemblies embodying the present invention.

Referring to FIGS. 1 and 2, the door panels 44, 46 have a structural core 54 of resin-impregnated kraft honeycomb 48, shown in FIG. 2, with 18 or 20 gauge, cold roll, galvanized or aluminized steel skins 50, 51, and 52, 53 bonded to core 54 under pressure. The orientation of the honeycomb core 48 within the panels 44, 46 is such that the longitudinal axis of the core 48 is at right angles to the skin 50, 51 and 52, 53 of panels 44, 46. Panel 44 has flush pulls 56 located on surfaces 52, 53 of the panel 44 at a height convenient to facilitate manual operation of the door 4. The flush pulls 56 are factory installed to minimize the number of asssembly steps necessary to erect the door 4 during installation. The lead edge 42 of panel 44 and the trail edge 60 of panel 46 are constructed of 14-gauge cold roll steel that is factory welded to the panels 44, 46 to give the trail edge 60 and the lead edge 42 an armor edge finish.

Figure 3:
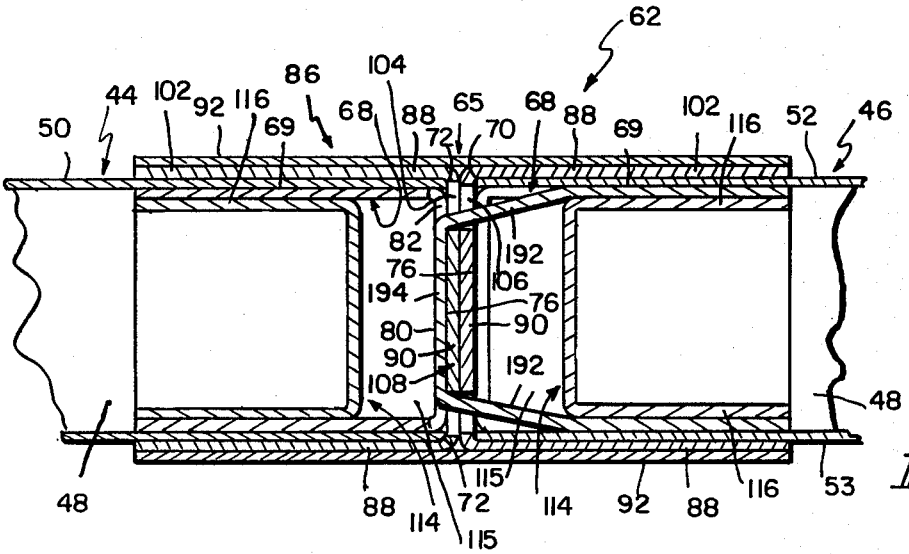
FIG. 3 is a cross-sectional view of the panel connection system shown in FIG. 2, taken generally along section lines 3—3 of FIG. 1.

Referring now to FIGS. 2 and 3, the two panels 44, 46 are interconnected by an edge-to-edge connection system 62. Once the panels 44, 46 are interconnected, tie bars 61 are attached over the top and bottom of the splice joint 65 to rigidly secure the panels 44, 46 in their interconnected configuration. In the preferred embodiment, the edge-to-edge connection system is the same as that disclosed in application Ser. No. 306,002, filed Sept. 28, 1981, which is assigned to the same assignee as this application.

The edge-to-edge connection system 62 includes vertical edge members 68 which are generally U-shaped in cross section and are connected to the abutting vertical edges 70 and 72 of the panels 46 and 44, respectively. Each vertical edge member 68 includes side sections 69 which engage the surfaces 50, 51 and 52, 53 of the panels 44 and 46. Each vertical edge member 68 also includes a vertical plate section 76 which engages and extends along the vertical edge 70 and 72 of the panels 46 and 44, respectively. Preferably a vertical edge member 68 fits into the edge 70, 72 of each panel 44, 46 so that the outer surfaces 50, 51 and 52, 53 extend over and conceal the side sections 69. The vertical plate section 76 extends 3/16 inch out past edges 70 and 72 so 3/16 inch of 69 is exposed. The outer surfaces 50, 51 and 52, 53 and side sections 69 are then spot-welded to each other to provide a connection therebetween. The vertical extension of outer surfaces 50, 51 and 52, 53 is sufficient to snugly accommodate a top recess channel 138 such that the side sections 139 of each channel 138 are flush with the top horizontal edges of outer surfaces 50, 51 and 52, 53. The recess channel 138 is secured to the outer surfaces 50, 51 and 52, 53 by conventional means such as welding.

The vertical plate section 76 of each vertical edge member 68 includes an alternating series of spaced-apart protuberances 80 and openings 82. The distance between each successive protuberance 80 and opening 82 is generally the same. Each protuberance 80 includes a generally trapezoidal-shaped aperture which is formed by two angular side sections 192 and an end section 194. The protuberances 80 project outwardly at a generally right angle to the vertical edges 70 and 72 of the panels 46, 44, respectively, to provide openings 84.

The alternating relationship of the protuberances 80 and the openings 82 on the vertical edge 72 of one of the panels 44 is generally opposite to the alternating relationship of the protuberances 80 and the openings 82 on the vertical edge 70 of the other panel 46 so that when the edges 70 and 72 are abutted, protuberances 80 along the vertical edge 70 of panel 46 are received in the openings 82 along the vertical edge 72 of panel 44, and protuberances 80 along the vertical edge 72 of panel 44 are received in the openings 82 along the vertical edge 70 of panel 46. In abutting edge-to-edge relationship, the openings 84 of all of the protuberances 80 are vertically aligned between the edges 70 and 72.

The vertical edges 70 and 72 are interlocked by a vertical locking member 86 which is generally H-shaped in cross section. The H-shaped locking member includes two opposed side sections 88 and a web section 90 therebetween. The side sections 88 and web section 90 are constructed from two vertical panels 92 which form the outer surface of the side sections 88 and two generally U-shaped vertical channel members 102 which are connected to each other and to the vertical panels by conventional means such as welding. The two U-shaped vertical channel members 102 form elongated vertical channels 104 which open in opposed directions for receiving the edge members 68 along the vertical edges 70 and 72 of panels 46 and 44, respectively.

The web section 90 of the locking member 86 includes a series of spaced-apart windows 106. The distance between each of the windows 106 corresponds generally to the distance between the protuberances 80 and openings 82 along the vertical edge members 68. Windows 106 provide a gateway for allowing passage of the protuberances through the web portion 90 of the locking member 86. Each window 106 includes a downwardly extending tongue or gate member 108 having a generally trapezoidal shape. Each of the tongues 108 is inserted into an aperture 82 formed by the protuberances 80 to interlock the panels 44 and 46. It should be noted that the tongues 108 have a maximum dimension 110 and minimum dimension 112. Apertures 84 in the protuberances 80 have a length which is slightly less than the maximum dimension 110 of the tongues 108 to provide a tight wedge-like connection between the tongues 108 and apertures 84.

In using the edge-to-edge connection system, the panels 44 and 46 are initially placed in adjacent edge-to-edge relationship with vertical edge 70 facing vertical edge 72. Locking member 86 is placed between the vertical edges 70 and 72 before they are butted together. Locking member 86 is raised slightly upwardly so that the tongues or gate members 108 in the web section 90 of the locking member 86 allow the protuberances 80 along each vertical edge member 68 to pass through the windows 106 in the web section 90. As the protuberances 80 are passed through the windows 106, the edge members 68 along the edges 70 and 72 of the panels 46 and 44, respectively, extend into the open channels 104 of the locking member 86 so that the side sections 88 engage the surfaces 50, 51 and 52, 53 of the panels 44 and 46. Once the protuberances have been inserted through the windows 106 so that they engage corresponding openings 82 in the opposite vertical edge member 68, the locking member 86 is driven downward to force the tongues or gate members 108 into the apertures 84 formed in the protuberances 80. Because of the slight difference between the maximum dimension 110 of the tongues 108 and the length of the apertures 84, the protuberances 80 are slightly deformed when the locking member 86 is driven, so that the tongues 108 can be forced into engagement with the apertures 84.

The two panels 44 and 46 are securely and rigidly connected by the interlocking of the protuberances 80 along each vertical edge member 68 and the tongues or gate members 108 in the web section 90 of the locking member 86. Further, the side sections 88 of the locking member 86 provide smooth surfaces on either side of the connection which blend with the surfaces 50, 51 and 52, 53 of the panels 44 and 46 and conceal the splice 65 between the two panels 44 and 46. The side sections 88 in cooperation with the surfaces 50, 51 and 52, 53 provide a seal along the connection between the two panels 44 and 46. Upon engagement of the edge-to-edge connection system 62, tie bar assemblies 150 are secured over the top and bottom of the splice joint 65.

The top tie bar assembly 150 includes a tie bar 61 and a suitably configured top recess channel 138 for connecting the tie bar 61 to the door panels 44 and 46. A bottom tie bar assembly 150 (shown in FIG. 4) includes the same elements as the top tie bar assembly 150.

A top door interlock 152 is connected to the top edges 71 and 73 of the panels 44 and 46 and includes door lip or flange 160 which protrudes downwardly in spaced relationship to the door 4. The lip 160 is suitably configured to slidably engage an upwardly protruding wall lip or flange 162 when the door 4 is in a closed position. The wall lip 162 is anchored to the wall opening by masonary bolts 164. The engagement between the door lip 160 and the wall lip 162 is such that it provides a flame barrier between the door 4 and the wall when door 4 is in a closed position to prevent the spread of fire between the top of the door 4 and the wall.

Figure 4:
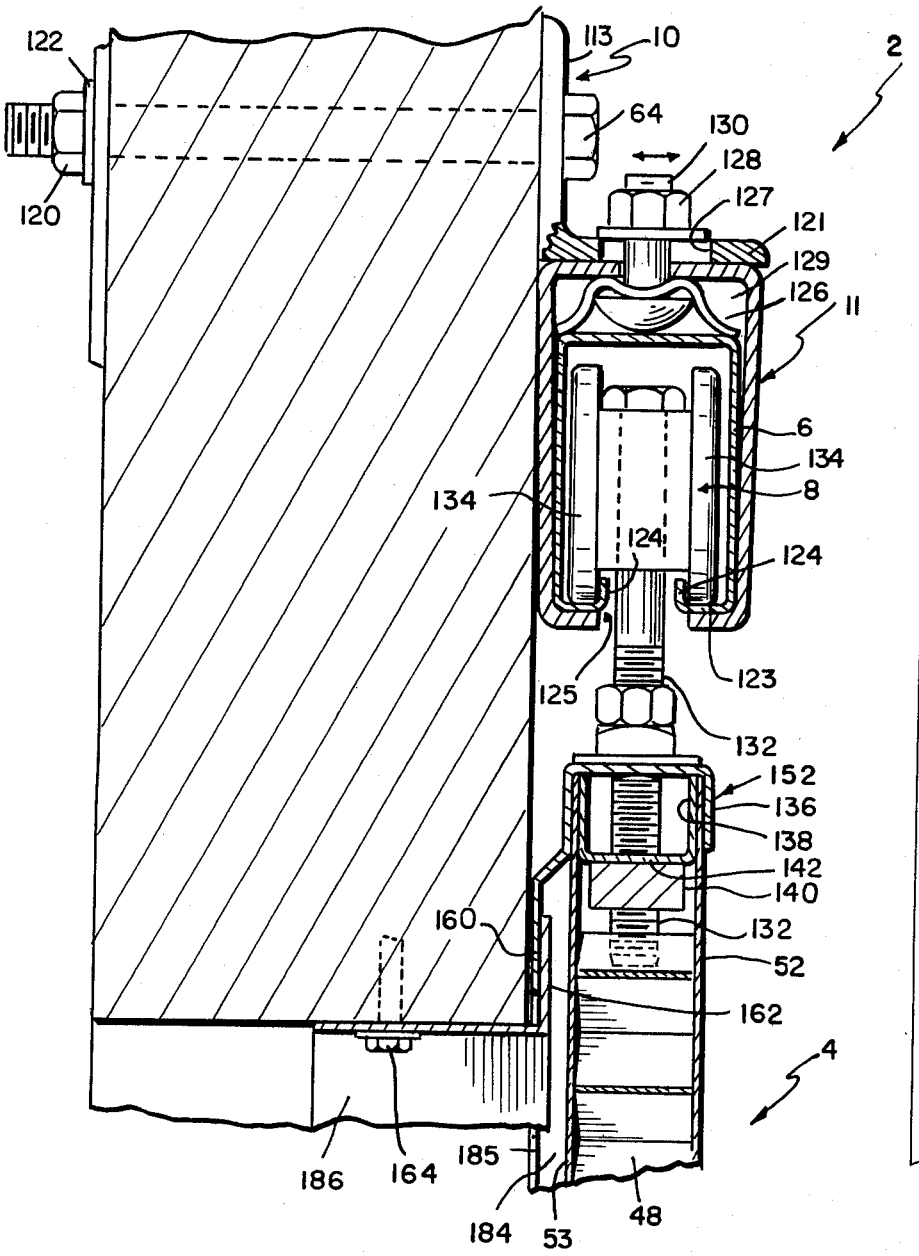
FIG. 4 is a cross-sectional view, partly broken away, of the fire door assembly shown in FIG. 1, taken generally along section lines 4—4 in FIG. 1.
Figure 4:
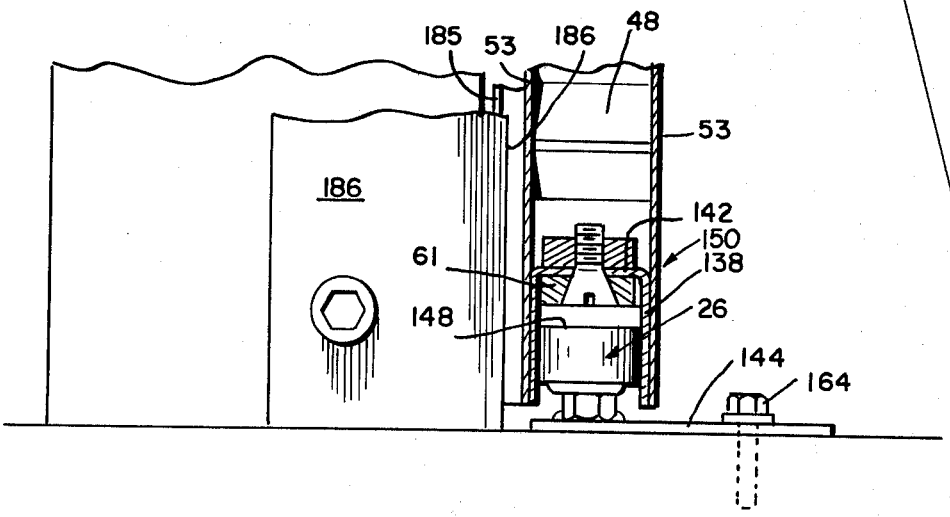

The tie bar 61 is centrally positioned with respect to its vertical axis over the edge-to-edge connection 65 of panels 44, 46 where it is rigidly anchored by any conventional means, such as a plurality of bolts 158. The bight of the door interlock 152 is configured to extend over the top recess channel 138. The inner cross-sectional dimension 154 of the door interlock 152 is slightly greater than the outer cross-sectional dimension 156 of the top edges 71, 73 of panels 44, 46 to provide a tight snug fit between the door interlock 152 and top edges 71, 73. The door interlock 152 is held firmly in position on the top recess channel 138 by the adjustable center posts 132 of the 4-wheel ball bearing hangers 8 when the posts 132 are bolted to and anchored in the panels 44, 46, as best shown in FIG. 4. A reinforcement bar 140 is provided on the plate section 142 of the recess channels 138.

Continuing to refer to FIGS. 2 and 3, the spread of fire from within a panel 44 or 46 is prevented by a flame-resistant U-shaped channel 114 embodying the present invention. The flame-resistant U-shaped channel 114 is received in the bight of the vertical edge member 68. The channel 114 engages and extends along the side sections 69 of the vertical edge member 68 so that the side sections 116 of the channel 114 are flush with side sections 69. The side sections 116 of the channel 114 are slightly shorter than side sections 69 of vertical edge member 68 so that a gap 115 is left between the front face 118 of the channel 114 and the vertical plate section 76 of vertical edge member 68. The bights of the channels 114 open inwardly to the door panels 44, 46 along the edges of the panels 44, 46 and receive the honeycomb core 54.

The side sections 116 of the flame-resistant U-shaped channel 114 extend in a direction opposite to the gap 115 between the front face 118 of the channel 114 and the vertical plate section 76 of the vertical edge member 68. The gap 115 that is left provides sufficient space to allow easy operation of the edge-to-edge connection system. The channel 114 is connected to the vertical edge member 68 by conventional means such as welding. The honeycomb core 48 of panels 44, 46 is completely enclosed within the door cavity. Channels 114 provide flame break barriers between the honeycomb cores 48 of the panels 44 and 46 and the splice or connection 65.

Referring now to FIG. 4, a first face 113 of the adjustable wall angle brackets 10 is supported from a wall by a machine bolt 64 that extends through the wall and is secured by a hex nut 120 and washer 122. The track bracket 11 containing the box track 6 is rigidly attached to a second face 121 of the adjustable wall angle brackets 10 by conventional means such as a nut 128 and bolt 130. The track bracket 11 is generally rectangular in shape and includes a longitudinal opening 129. The box track 6 is somewhat rectangular in shape. The bottom surface 123 of track 6 includes flanges 124 extending inwardly and then upwardly to provide a longitudinal opening 125 coinciding with opening 129. The flanges 124 form spaced-apart generally U-shaped channels for the 4-wheel ball bearing hangers 8 to freely slide along the box track 6. The box track 6 is secured inside the track bracket 11 by a track hold-down clamp 126. The track hold-down clamp 126 is held in position inside of the track bracket 11 by bolt 130 and nut 128 such that it clamps with a sufficient downward force to hold the box track 6 within the track bracket 11.

The track hold-down clamp 126 is positioned between the box track 6 and the track bracket 11. In the eventuality that the bolt 130 and nut 128 work loose over a period of time, there is no danger of the clamp 126, the bolt 130, or nut 128 becoming positioned in such a manner that it would restrict the four-wheel ball bearing hanger 8 from freely sliding along the box track 6. Slots 127 in the second faces 121 of the adjustable wall angle brackets 10 permit adjustment of the track bracket 11 and box track 6 relative to the wall to help prevent binding between the wall and the assembled door 4.

The 4-wheel ball bearing hangers 8 have an adjustable center post 132. One end of the adjustable center post 132 is connected to the wheels 134 of the hangers 8. The other end of the center post 132 is anchored to the door interlock 152 and the top recessed channel 138. In operation, the adjustable center post 132 may be adjusted as needed to provide sufficient ground clearance for the door assembly 4 to travel freely along box track 6.

The concealed stay roller 26 is secured to the ground by an adjustable hex nut sleeve anchor 144. The concealed stay roller 26 is completely enclosed within the bottom recessed channel 138 of panels 44, 46. The door is adjusted by the adjustable center post 132 so that the top portion 148 of the concealed stay roller 26 does not rub, bind, or come in contact with the vertical plate section 142 of bottom recessed channel 138 or with tie bar 61.

Figure 5:
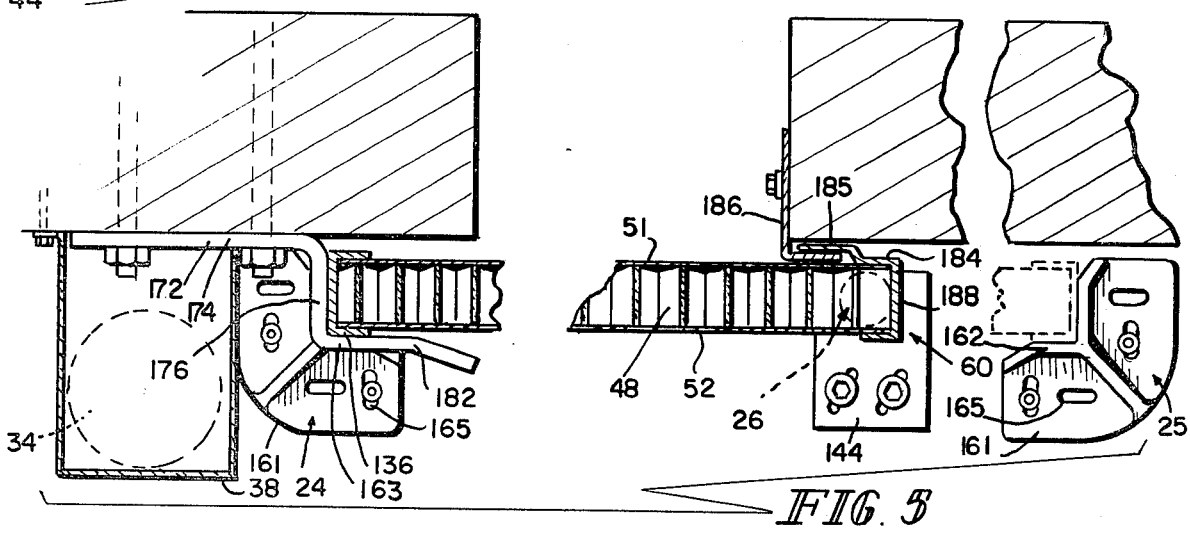
FIG. 5 is a top elevational view, partly broken away and cross-sectioned, of the door assembly of FIG. 1.

FIG. 5 shows the optional adjustable end stops 24, 25. The end stops 24, 25 are L-shaped with an arcuate outer surface 161 and a right-angled inner surface 163. End stop 24 snugly receives the lead armor edge 136 of panel 44. Both end stops 24 and 25 have a plurality of openings 165 that permit adjustment relative to the door 4. The stops 24, 25 as previously stated are not necessarily used with the fire door assembly 2 as the sheaves 30, 32 can be used as stops.

Upper and lower binders 172 are attached to the wall by use of conventional means such as bolts and nuts. The binders are configured such that when their faces 174 are secured to the wall, angled portions 176 and 182 form upper and lower channels with the wall. As the door closes, the lead armor edge 136 of panel 44 is guided by portions 182 of upper and lower binders 172 into the channels.

The trail edge 60 of the door 4 includes a side door interlock 184. The door interlock 184 includes a lip or flange 185 in spaced relationship to the surface 51 of panel 46. Lip 185 is suitably configured to slidably engage a protruding wall lip 186 when the door 4 is in a closed position. The seal between the side lip 184 and the protruding wall lip 186 is such that it effectively closes the periphery between the door 4 and the wall when door 4 is in a closed position to provide a side flame barrier between the door 4 and wall.

In use, the door assembly 2 is manufactured in such a manner as to minimize installation time and reduce the maintenance required to keep the assembled door operating smoothly and trouble-free. By utilizing the above-described kit, all that is necessary to erect and install the door assembly 2 is a number of easily performed installation steps. The adjustable wall hanger brackets 10 are positioned and secured to the wall above the opening to be closed. The track brackets 11 are secured to the wall angle brackets 10. The box track 6 is positioned and secured within the track brackets 11 by the track hold-down clamps 126. Door panels 44 and 46 are connected to each other using the edge-to-edge connection system 62 which includes flame-resistant channels 114. Depending upon the size of the opening to be closed, any number of panels can be joined together using a plurality of edge-to-edge connection systems 62. After the panels 44 and 46 are connected, tie bars 61 are installed within the recessed channels 138 to rigidly secure the edge-to-edge connection system 62 in a locked configuration. The top door interlock 152 is slid into position, and the four-wheel ball bearing hangers 8 are positioned and secured on the assembled door 4. The door can then be hung from the box track 6. When hanging the door 4, the concealed stay roller 26 is positioned in the bottom recess channel 138 by swinging the assembled door 4 out away from the wall far enough to slide the concealed stay roller 26 into the channel 138. The door may then be swung back towards the wall and the concealed stay roller 26 secured by use of the adjustable hex nut sleeve anchor 144. Travel of the door 4 along box track 6 is restricted so that when the door 4 is in a closed position the side door interlock 184 of trail edge 60 and the upper door interlock 152 snugly engage the wall lips 160 and 186 so as to effectively seal the periphery between the door 4 and the wall.

Next, the pulley system 28 is installed. The sheave assemblies 30 and 32 are positioned and secured and the cable 36 is rigged to the counterweight 34 and the fuse link device 39 so that upon the breakage of the fuse link device 39 the counterweight 34 will descend in the weight box 38 and pull the door 4 to a closed position. Upon completion of this easy step-by-step installation of the fire door, very little maintenance is required to keep the door in operating condition. Maintenance can be limited to periodic inspections to be certain that all parts are functioning properly and freely.

What is claimed is:

1. A fire door assembly for closing an opening in a wall, the door assembly comprising at least two panels having edges to be connected, interconnecting means for connecting an edge of one of the door panels to an adjacent edge of the other door panel in edge-to-edge relationship, flame-resistant means providing a flame barrier between said interconnecting means and the edges of the panels, track means for slidably supporting the interconnected panels, and mounting means for mounting the track means to the wall above the opening.

2. The assembly of claim 1, further comprising a pair of tie bars for reinforcing the connection between the two panels, means for mounting the tie bars to the panels, generally transverse to the connected edges such that each tie bar extends over the connection between the panels.

3. The assembly of claim 1 wherein the interconnecting means includes a pair of continuous U-shaped strips, each strip being fixed along the edge of one of the door panels to be connected, each strip including a plurality of spaced-apart protuberances projecting away from the edge to which the strip is fixed, each protuberance having a first contact surface facing toward the edge to which the strip is fixed, and locking means interposed between the pair of strips, the locking means including a linear plate having a plurality of apertures, means in each aperture providing a second contact surface for engagement with the first contact surface of a protuberance to prevent separation of the edges and wherein the flame-resistant means includes a pair of continuous channels, each channel being interposed between a strip and the edge to which the strip is fixed such that the channel extends into the bight of the strip to provide a flame-resistant barrier between the strip and the edge.

4. The assembly of claim 2 wherein the flame-resistant channels are generally U-shaped, each strip and channel fixed to the edge including a continuous surface in parallel relationship to the edge, the continuous surfaces of each corresponding strip and channel being in spaced parallel relationship to each other.

5. A fire door assembly for closing an opening in a wall, the door assembly comprising at least two door panels, each door panel having a top edge, a bottom edge, and side edges, interconnecting means for connecting a side edge of one of the door panels to an adjacent side edge of the other door panel in edge-to-edge relationship, the interconnecting means including a pair of continuous U-shaped strips, each strip being fixed along the side edge of one of the door panels to be connected, each strip including a plurality of spaced-apart protuberances projecting away from the side edge to which the strip is fixed, each protuberance having a first contact surface facing toward the side edge to which the strip is fixed, locking means interposed between the pair of strips, the locking means including a linear plate having a plurality of apertures, means in each aperture providing a second contact surface for engagement with the first contact surface of a protuberance to prevent separation of the side edges, flame-resistant means providing a flame barrier between the interconnecting means and the interconnected side edges, the flame-resistant means including a pair of continuous channels, each channel being interposed between a strip and the side edge to which the strip is fixed such that the channel extends into the bight of the strip to provide a flame-resistane barrier between the strip and the side edge, track means for slidably supporting the interconnected panels, and mounting means for mounting the track means to the wall above the opening.

6. The assembly of claim 5 wherein the flame-resistant channels are generally U-shaped, each strip and channel fixed to the side edge including a continuous surface in parallel relationship to the side edge, the continuous surfaces of each corresponding strip and channel being in spaced parallel relationship to each other.

7. The assembly of claim 6, further comprising a pair of tie bars for reinforcing the connection between the two panels, means for mounting a first tie bar to the top edges of both panels, and means for mounting a second tie bar to the bottom edges of both panels, the first and second tie bars extending along the top and bottom edges, respectively, over the connection between the panels.

8. A fire door assembly for closing an opening in a wall including means for automatically closing the door in response to a predetermined temperature, the door asembly comprising at least two door panels, each door panel including a top edge, a bottom edge, and side edges, interconnecting means for interconnecting the side edge of one of the door panels to an adjacent side edge of the other door panel in edge-to-edge relationship, the interconnecting means including a pair of substantially continuous U-shaped strips, each strip being fixed along the side edge of one of the panels to be connected, each strip including a plurality of spaced-apart protuberances projecting away from the side edge to which the strip is fixed, each protuberance having a first contact surface facing toward the side edge to which the strip is fixed, locking means interposed between the pair of strips, the locking means including a linear plate having a plurality of apertures, means in each aperture providing a second contact surface for engagement with the first contact surface of a protuberance to prevent separation of the side edges, flame-resistant means providing a flame barrier between the interconnecting means and the interconnected side edges, the flame-resistant means including a pair of substantially continuous U-shaped channels, each channel being interposed between a strip and the side edge to which the strip is fixed such that the channel extends into the bight of the strip, track means for slidably supporting the interconnected door panels, mounting means including at least one track bracket for containing the track means and retaining means for retaining the track means within the track bracket, the retaining means including a spring interposed between the track bracket and the track means, said spring biasing the track means into frictional engagement with the track bracket, and interlock means for interlocking the door panels and the wall, the interlock means including a first flange extending at least partially along the periphery of the opening and a second flange extending along the top edge and at least one side edge of the interconnected panels, the second flange being received in the first flange to provide a flame barrier between the door panels and the wall when the door is closed.

9. A fire door assembly for closing an opening in a wall, comprising at least two door panels, each door panel including a substantially continuous strip fixed along one of its edges and a channel providing a flame barrier between the strip and the edge to which the strip is fixed, each strip including a plurality of spaced-apart protuberances projecting away from the side edge to which it is fixed, each protuberance having a first contact surface facing toward the side edge to which the strip is fixed, a linear plate having a plurality of apertures, means in each aperture providing a second contact surface for engagement with the first contact surface of a protuberance to connect the door panels in edge-to-edge relationship, at least one track housing, means for mounting the housing to the wall above the opening, a track in the track housing for supporting the connected doors, and retaining means for biasing the track into frictional engagement with the housing to retain the track in the housing.

10. A fire door assembly for closing an opening in a wall, the door assembly comprising at least two door panels having edges to be connected, interconnecting means for connecting an edge of one of the door panels to an adjacent edge of the other door panel in edge-to-edge relationship, and flame-resistant means providing a flame barrier between said interconnecting means and the edges of the panels.

11. The assembly of claim 10 wherein the interconnecting means includes a pair of continuous U-shaped strips, each strip being fixed along the edge of one of the door panels to be connected, each strip including a plurality of spaced-apart protuberances projecting away from the edge to which the strip is fixed, each protuberance having a first contact surface facing toward the edge to which the strip is fixed, and locking means interposed between the pair of strips, the locking means including a linear plate having a plurality of apertures, means in each aperture providing a second contact surface for engagement with the first contact surface of a protuberance to prevent separation of the edges and wherein the flame-resistant means includes a pair of continuous channels, each channel being interposed between a strip and the edge to which the strip is fixed such that the channel extends into the bight of the strip to provide a flame-resistant barrier between the strip and the edge.

12. The assembly of claim 11 wherein the flame-resistant channels are generally U-shaped, each strip and channel fixed to the edge including a continuous surface in parallel relationship to the edge, the continuous surfaces of each corresponding strip and channel being in spaced parallel relationship to each other.

13. The assembly of claim 10, further comprising a pair of tie bars for reinforcing the connection between the two panels, means for mounting the tie bars to the panels, generally transverse to the connected edges such that each tie bar extends over the connection between the panels.

14. The assembly of claim 13 further comprising track means for slidably supporting the interconnected door panels, mounting means including at least one track bracket for containing the track means, and retaining means for retaining the track means within the track bracket, the retaining means including a spring interposed between the track bracket and the track means, said spring biasing the track means into frictional engagement with the track bracket.

15. The assembly of claim 14 further comprising interlock means for interlocking the door panels and the wall, the interlock means including a first flange extending at least partially along the periphery of the opening and a second flange extending along the top edge and at least one side edge of the interconnected panels, the second flange being received in the first flange to provide a flame barrier between the door panels and the wall when the door is closed.

* * * * *

UNITED STATES PATENT AND TRADEMARK OFFICE

CERTIFICATE OF CORRECTION

PATENT NO. : 4,467,562

DATED : August 28, 1984

INVENTOR(S) : Gene A. Hemmerling

It is certified that error appears in the above-identified patent and that said Letters Patent is hereby corrected as shown below:

Column 8, line 19 (claim 1), after "two", insert --door--.

Signed and Sealed this

*Twenty-sixth* Day of *March 1985*

[SEAL]

*Attest:*

DONALD J. QUIGG

*Attesting Officer*

*Acting Commissioner of Patents and Trademarks*